US007764894B2

(12) United States Patent
Tanaka

(10) Patent No.: US 7,764,894 B2
(45) Date of Patent: Jul. 27, 2010

(54) IMAGE FORMING APPARATUS AND METHOD WITH CONTROL OF IMAGE HEATING CONDITION BASED ON DESIRED GLOSSINESS DIFFERENCE BETWEEN ACHROMATIC IMAGE PORTION AND COLOR IMAGE PORTION

(75) Inventor: Sumito Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 764 days.

(21) Appl. No.: 11/610,083

(22) Filed: Dec. 13, 2006

(65) Prior Publication Data

US 2007/0140716 A1 Jun. 21, 2007

(30) Foreign Application Priority Data

Dec. 16, 2005 (JP) ..... 2005-363188

(51) Int. Cl.
*G03G 15/20* (2006.01)

(52) U.S. Cl. ..... 399/68; 399/67; 399/69

(58) Field of Classification Search ..... 399/67–69
See application file for complete search history.

(56) References Cited

U.S. PATENT DOCUMENTS 6,088,546 A 7/2000 Inoue et al. ..... 399/45
6,101,345 A * 8/2000 Van Goethem et al. ..... 399/69

FOREIGN PATENT DOCUMENTS

| | | |
|---|---|---|
| JP | 4-204669 | 7/1992 |
| JP | 04204670 A * | 7/1992 |
| JP | 7-129039 | 5/1995 |
| JP | 8-202199 | 8/1996 |
| JP | 11-084770 | 3/1999 |

OTHER PUBLICATIONS

English Abstract of JP 04204670 A, Kubo et al.*

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image forming apparatus includes an image forming device for forming a multi-color image using achromatic toner and chromatic toner; an image heating device for heating the multi-color image formed on a recording material; a setting device for setting a glossiness difference between an achromatic image portion and a color image portion; and a change device for changing an image heating condition of the image heating means in accordance with the set glossiness difference.

14 Claims, 11 Drawing Sheets

☐ GLOSS. SELECTION MODE

CLR-CLEAR & MONOCHRO-MATT MODE
CLR-HALF-CLEAR CLR & MONOCHRO-HALF-MATT MODE
CLR-DULL & MONOCHRO-MATT MODE
CLR & MONOCHRO NORMAL MODE

IMAGE FORMING APPARATUS AND METHOD WITH CONTROL OF IMAGE HEATING CONDITION BASED ON DESIRED GLOSSINESS DIFFERENCE BETWEEN ACHROMATIC IMAGE PORTION AND COLOR IMAGE PORTION

FIELD OF THE INVENTION

The present invention relates to an image forming apparatus and an image forming method for forming an image using an electrophotographic type or electrostatic recording type process. The image forming apparatus may be a color copying machine, a color printer and a color facsimile, for example.

DESCRIPTION OF RELATED ART

Recently, the color management environment has been developed. For example, such a printer comes to be used as a proofer in a design field, wherein it is desired that colors provided by the printer are the same as those of an offset printing machine, as well as the high speed monochromatic printing.

As for the image density and/or color information of the image, the printer is controlled such that they are store as much as possible. In addition, the high image quality output is accomplished by use of toner having a wide color reproduction range and/or by improvement in the dot reproducibility in order to reproduce faithfully the original image.

Thus, the image forming apparatus of the electrophotographic type comes to used in the design field as a proofer for color proof in addition to so-called office use.

Recently, a glossiness of an image is taken into account as a factor to further improve the image quality toward that of an offset print image.

In an office, for example, the glossiness property would be adjusted to make the image conspicuous for presentation or for advertisement.

Thus, there is a need in the market for the printer capable of emphasizing the monochromatic image portion (letter portion) in a full-color output image, or for emphasizing the color image portion (photograph portion).

Japanese Laid-open Patent Application Hei 8-202199 proposes formation of an image while changing the fixing speed and/or the fixing temperature in the fixing device in accordance with the glossiness of the original. Japanese Laid-open Patent Application Hei proposes increasing or decreasing the glossiness by changing the pressure in the fixing device.

Japanese Laid-open Patent Application Hei 4-204669 proposes use of toner capable of raising the glossiness and toner capable of lowering the glossiness, wherein by selecting the toner, the prints can be produced with high glossiness or low glossiness.

Japanese Laid-open Patent Application Hei 7-129039 proposes an apparatus equipped with four image forming stations for forming high glossiness images and four image forming stations for forming low glossiness images. In such an apparatus, the high glossiness image forming stations are used for reproduction of graphic image area of the intended image, and the low glossiness image forming stations are used for reproduction of letter areas.

However, with the apparatuses disclosed in Japanese Laid-open Patent Application Hei 8-202199, Japanese Laid-open Patent Application Hei 11-84770 and Japanese Laid-open Patent Application Hei 4-204669, the glossiness of the whole surface of the output image is uniformly controlled, and it has not been possible to control the glossinesses within an output image.

The apparatus disclosed in Japanese Laid-open Patent Application Hei 7-129039 is bulky, and there is a difference in the glossiness between the graphic image area and the letter image area, but the glossiness difference cannot be changed.

SUMMARY OF THE INVENTION

Accordingly, it is a principal object of the present invention to provide an image forming apparatus and an image forming method with which a glossiness difference between an achromatic color image portion and a chromatic color image portion can be changed with a simple and easy structure.

According to an aspect of the present invention, there is provided an image forming apparatus comprising an image forming device for forming a multi-color image using achromatic toner and chromatic toner; an image heating device for heating the multi-color image formed on a recording material; a setting device for setting a glossiness difference between an achromatic image portion and a color image portion; and a change device for changing an image heating condition of said image heating means in accordance with the set glossiness difference.

According to another aspect of the present invention, there is provided an image forming method comprising an image forming step of forming a multi-color image using achromatic toner and chromatic toner; an image heating step of heating the multi-color image formed on a recording material; a setting step of setting a glossiness difference between an achromatic image portion and a chromatic image portion; and a change step of changing an image heating condition of said image heating means in accordance with the set glossiness difference.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
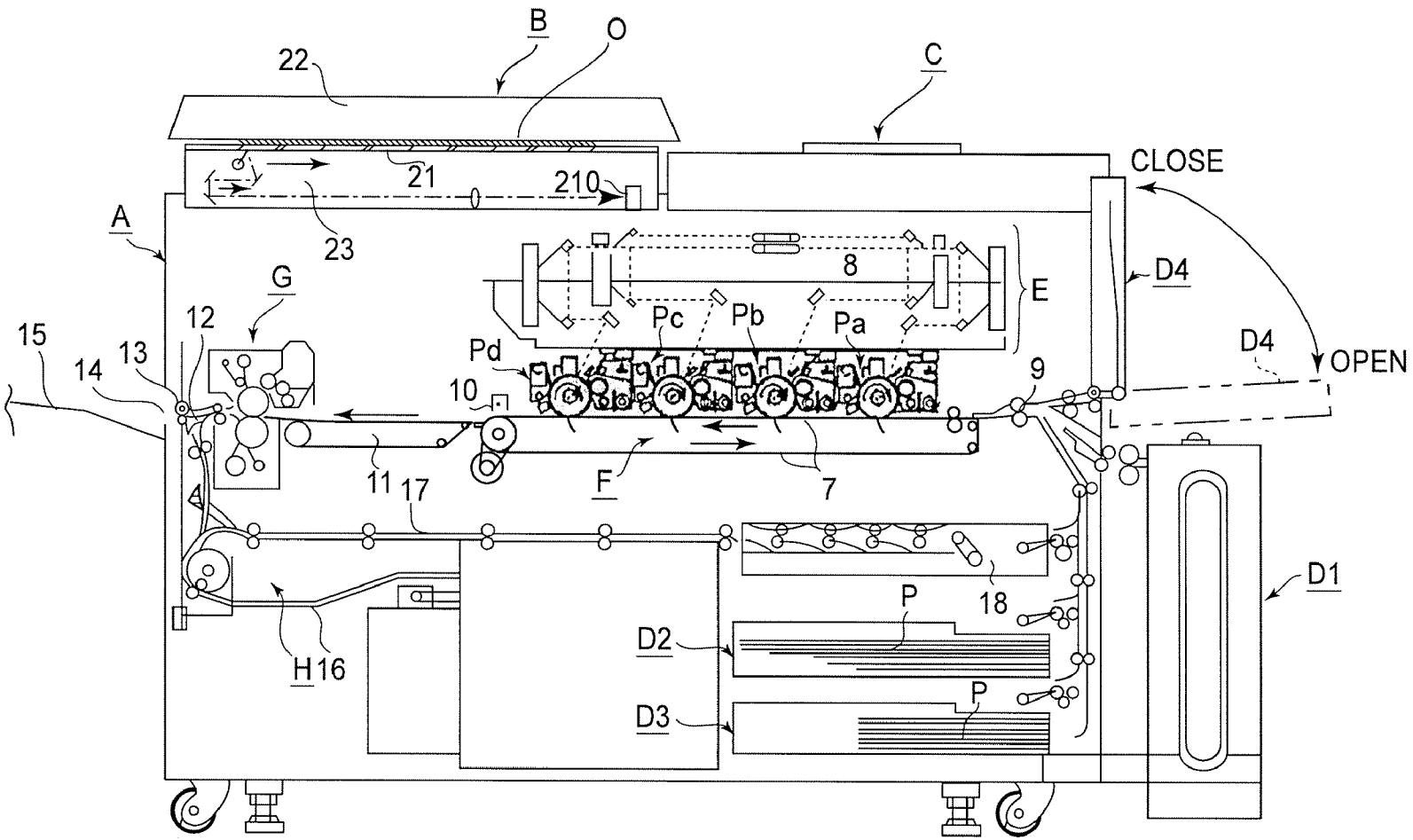
FIG. 1 is a schematic illustration of an image forming apparatus according to Embodiment 1 of the present invention.

(1) General Arrangement of Image Forming Apparatus:

FIG. 1 is a schematic view illustrating a general arrangement of an image forming apparatus according to this embodiment of the present invention. The image forming apparatus of this example is a laser beam printer (copying machine) for producing full-color images by four colors through the electrophotographic process.

Designated by A be a printer station containing an electrophotographic processing mechanism for forming a full-color image on a recording material. Designated by B and C are an original reading station and a display portions, respectively, provided above the printer station A. The original reading station B optically scans a full-color original placed on an original reading station B and reads the image by color separating photo-electric process to provide an image signal for each separated color. The operation panel screen C is used to input commands by the operator and to notify the operator of the state of apparatus. Designated by D1 is a large capacity paper deck, provided connected to the printer station A at the right-hand side in the Figure, for sheet feeding recording material to the printer station A.

In the printer station A, there is provided an image forming device for forming an image on the recording material as will be described below.

Designated by Pa, Pb, Pc and Pd are first to fourth image forming stations arranged horizontally from right to left in the Figure (in-line structure or tandem structure). Designated by E is a laser scanning mechanism ( ) having an plurality of optical scanning means disposed above the first to fourth image forming stations. Designated by F is a transfer belt mechanism disposed below the first to fourth image forming stations. Designated by D2 the D3 are first and second sheet feeding cassettes (cassette sheet feeders) including two stages, disposed below transfer belt mechanisms F. Designated by D4 is a manual insertion sheet feeding tray (manual insertion sheet feeder) provided at the right-hand side of the printer station A in the Figure. The manual insertion sheet feeding tray D4 is foldable toward the printer station A as indicated by solid lines when it is not used. When it is used, it is expanded outward as indicated by chain lines.

Designated by G is a fixing device provided downstream of the transfer belt mechanism F with respect to the recording material feeding direction.

In the original reading station B, designated by 21 is an original supporting platen glass, 22 is an original confining plate which is openable and closable relative to the original supporting platen glass. A full-color original to print is placed face down on the original supporting platen glass 21 in accordance with a predetermined supporting reference and is covered by the original confining plate 22, thus setting the original O in place. The original confining plate 22 may be replaced with an original automatic feeding apparatus (ADF, RDF) so that original O can be fed automatically onto the original supporting platen glass 21. Designated by 23 is a movement optical system which is driven and moved along a lower surface of the original supporting platen glass 21. The movement optical system 23 optically scans the downward facing image surface O the original on the original supporting platen glass 21. The light reflected by the original is imaged on a photoelectric conversion element (solid matter picture taking element) CCD210, and is read for each of three primary colors (red, green, blue). In this example, the original image is read with a resolution of 600 dpi, and the read RGB signals are inputted to an image processor 209 (FIG. 7) which will be described hereinafter.

The image processor 209 controls the laser scanning mechanism E to output laser beams modulated corresponding to the image information from the original reading station B to the first to fourth image forming stations Pa, Pb, Pc and Pd.

Figure 2:
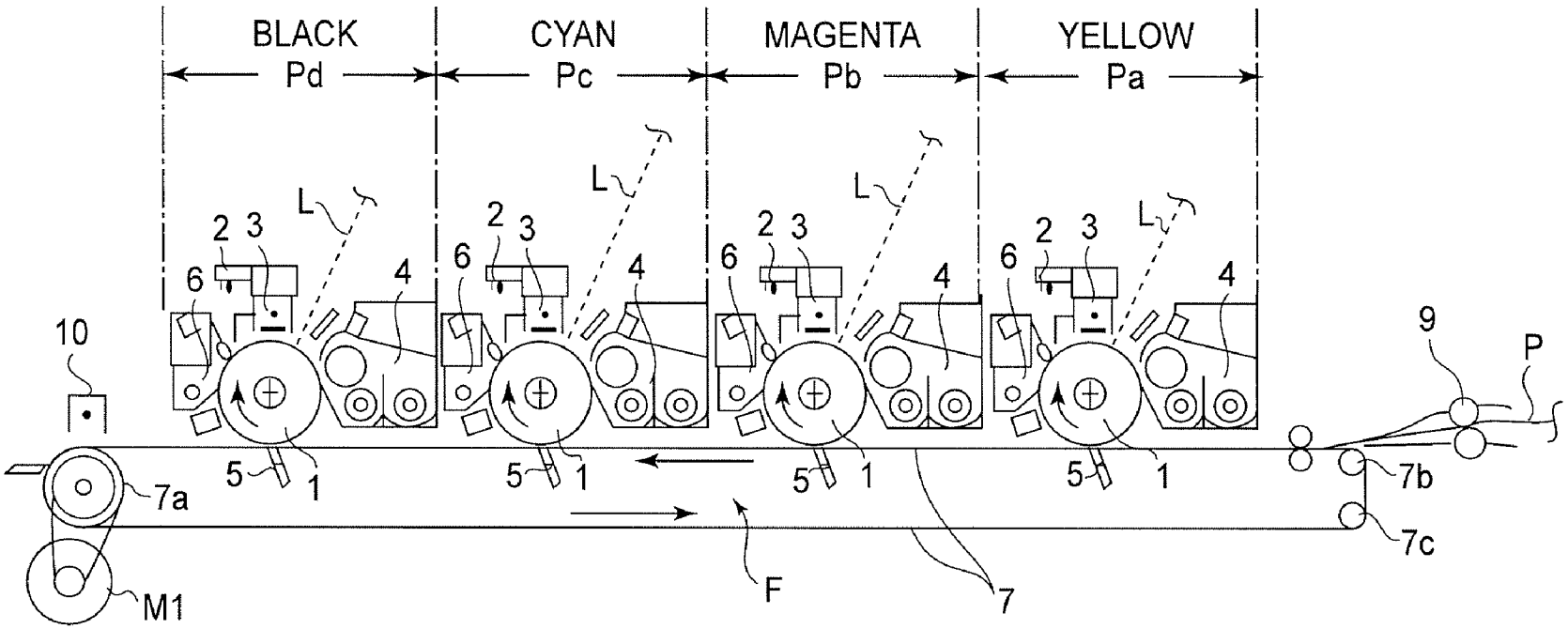
FIG. 2 is an enlarged view of first to fourth image forming stations and transfer belt mechanism portions.

FIG. 2 is an enlarged view of the first to fourth image forming stations Pa, Pb, Pc and Pd and the transfer belt mechanism F. The first to fourth image forming stations have structures similar to each other. Each of them is provided with an electrophotographic photosensitive drum (photosensitive drum) 1 as the image bearing member. Around the photosensitive drum 1, there are provided process means actable on the photosensitive drum 1, including a whole surface exposure lamp (discharging lamp) 2, a primary charger 3, a developing device 4, a transfer charger 5, a drum cleaner 6 and so on.

The developing devices 4 of the first to fourth image forming stations Pa, Pb, Pc and Pd contain yellow (Y) toner, magenta (M) toner, cyan (C) toner and black (Bk) toner, respectively. The yellow color toner, magenta color toner and cyan color toner are chromatic coloring materials, and black toner is an achromatic coloring material.

The transfer belt mechanism F comprises an endless transfer belt 7, a driving roller 7*a* and turn rollers 7*b*, 7*c* which stretch the transfer belt 7. The driving roller 7*a* is rotated by a driving motor M1 through a power transmitting apparatus such as a timing belt apparatus, so that transfer belt 7 is rotated at a predetermined speed in a counterclockwise direction indicated by an arrow. The transfer belt 7 is made of dielectric member resin material such as polyethylene terephthalate resin material sheet (PET resin material sheet), polyvinylidene fluoride resin material sheet or polyurethane resin material sheet. The opposite ends of a sheet of such a material is overlapped and bonded into an endless configuration, or a seamless belt not having such a connecting portion sheet is used.

A full-color image forming operation will be described. The first to fourth image forming stations Pa, Pb, Pc, Pd are driven sequentially at predetermined control timing for image formation. By this, the photosensitive drums 1 are rotated in the clockwise direction indicated by an arrow. In addition, the transfer belt 7 of the transfer belt mechanism F is also rotated. Furthermore, the laser scanning mechanism E is also driven. In synchronism with the driving operation, the primary charger 3 charges uniformly the surface of the photosensitive drum 1 to a predetermined potential of a predetermined polarity. The laser scanning mechanism E effects the laser beam scanning exposure in accordance with the image signal. By doing so, an electrostatic latent image is formed on the surface of the photosensitive drum 1 in accordance with the image signal. More particularly, the laser scanning mechanism E receives the laser beam emitted from the light source device and reflects the laser beam by rotating the polygonal mirror 8. The laser beam is then deflected by a reflection mirror and is condensed on the photosensitive drum 1 by a fθ lens. By this, an electrostatic latent image is formed in accordance with the image signal on the photosensitive drum. The electrostatic latent image thus formed is developed by the developing device 4 into a toner image.

By such an electrophotographic process operation, on the peripheral surface of the photosensitive drum 1 of the first image forming station Pa, a yellow color toner image (yellow color component of the full-color image) is formed. In a similar manner, a magenta color toner image (magenta component of the full-color image) is formed on the peripheral surface of the photosensitive drum 1 of the second image forming station Pb. On the peripheral surface of the photosensitive drum 1 of the third image forming station Pc, a cyan color toner image (cyan component of the full-color image) is formed. On the peripheral surface of the photosensitive drum 1 of the fourth image forming station Pd, a black color toner image (black color component of the full-color image) is formed.

On the other hand, among the large capacity sheet feeding apparatus D1, the first sheet feeding cassette D2, the second sheet feeding cassette D3 and the manual insertion sheet feeding tray D4, a sheet feeding roller of the selected sheet feeder is driven. By this, a recording material P is singled out of the sheet feeder. The recording material P is supplied onto the transfer belt 7 of the transfer belt mechanism F through a plurality of feeding rollers and registration rollers 9. The recording material P supplied onto the transfer belt 7 is fed sequentially to the transfer portions of the first to fourth image forming stations Pa, Pb, Pc, Pd by the transfer belt 7.

More particularly, the transfer belt 7 of the transfer belt mechanism F is rotated by the driving roller 7*a*, and when it is detected that transfer belt 7 is at a predetermined position, the recording material P is delivered to the transfer belt 7 from the registration roller 9, and is fed toward the transfer portion of the first image forming station Pa. Simultaneously therewith, an image writing signal is rendered on, and at predetermined timing thereafter, the image formation is carried out in the first image forming station Pa on the photosensitive drum 1. In the transfer portion below the photosensitive drum 1, the transfer charger 5 applies an electric field or electric charge, so that first color yellow toner image formed on the photosensitive drum 1 is transferred onto the recording material P. By the transfer, the recording material P is firmly retained on the transfer belt 7, and is fed sequentially to the transfer portions of the second to fourth image forming stations Pb, Pc, Pd. The recording material P sequentially receives the magenta, cyan and black toner images in an overlapping manner from the photosensitive drums of the image forming stations. By this, a full-color toner image is formed on the recording material P.

The recording material P now carrying the toner image color full-color is electrically discharged by a separation charger 10 at a position downstream portion of the transfer belt 7 with respect to the moving direction of the transfer belt 7 so that electrostatic attraction force is attenuated, and the recording material P separates from the end of the transfer belt 7. Under a low humidity ambient condition, the recording material P is dry, and therefore, the electric resistance thereof is high with the result that electrostatic attraction force to the transfer belt 7 is great, and the effect of the separation charger 10 is significant. Normally, the separation charger 10 charges the recording material P in a state that toner image thereon is unfixed, and therefore, a non-contact charging device is used.

The recording material P separated from the transfer belt 7 is fed to the fixing device G by the feeding belt 11, where it is heated and pressed so that color toner images are mixed and fixed on the recording material P, thus producing a full-color print.

When a one surface image formation mode is selected, the recording material P discharged from the fixing device G passes above a selector 12 held at a first attitude and is discharged by sheet discharging rollers 13 through a sheet discharge opening 14 onto a sheet discharge tray 15.

When a both sides image formation mode is selected, the recording material P discharged from the fixing device G and having the fixed image on the first side is deflected toward the reversion re-sheet feeding mechanism H by the selector 12 which is in the second position in this case. By the reversion re-sheet feeding mechanism H, more particularly, by a reversion portion (switch back mechanism) 16, the face orientation of the recording material is reverted and is fed to the both sides feeding path 17. It is once accommodated in an intermediary tray 18. The recording material accommodated in the intermediary tray 18 is delivered from the intermediary tray 18 toward the registration rollers 9 by sheet feeding rollers driven at predetermined control timing, and from the registration roller 9, it is refed onto the transfer belt 7 of the transfer belt mechanism F with the second side up. Similarly to the image formation on the first side, a color full-color toner image is formed on the second side by the first to fourth image forming stations Pa, Pb, Pc, Pd.

The recording material P having subjected to the toner image formation on the second side is separated from the transfer belt 7 and is fed to the fixing device G, and is subjected to the fixing process on the second side thereof. Then, the recording material P is fed above the selector 12 now in the first position and is sheet discharged by the sheet discharging rollers 13 through the sheet discharge opening 14 onto the sheet discharge tray 15 as a both sided print.

A monochromatic print can be produced. In such a case, the monochromatic image formation mode is selected, and the image forming station of only the corresponding one of the first to fourth image forming stations Pa, Pb, Pc, Pd carries out the image forming operation. The other image forming stations do not perform the image forming operation although the photosensitive drum is rotated. In the transfer portion of the operated image forming station, the toner image is transferred onto the recording material P fed by the transfer belt mechanism F.

Figure 3:
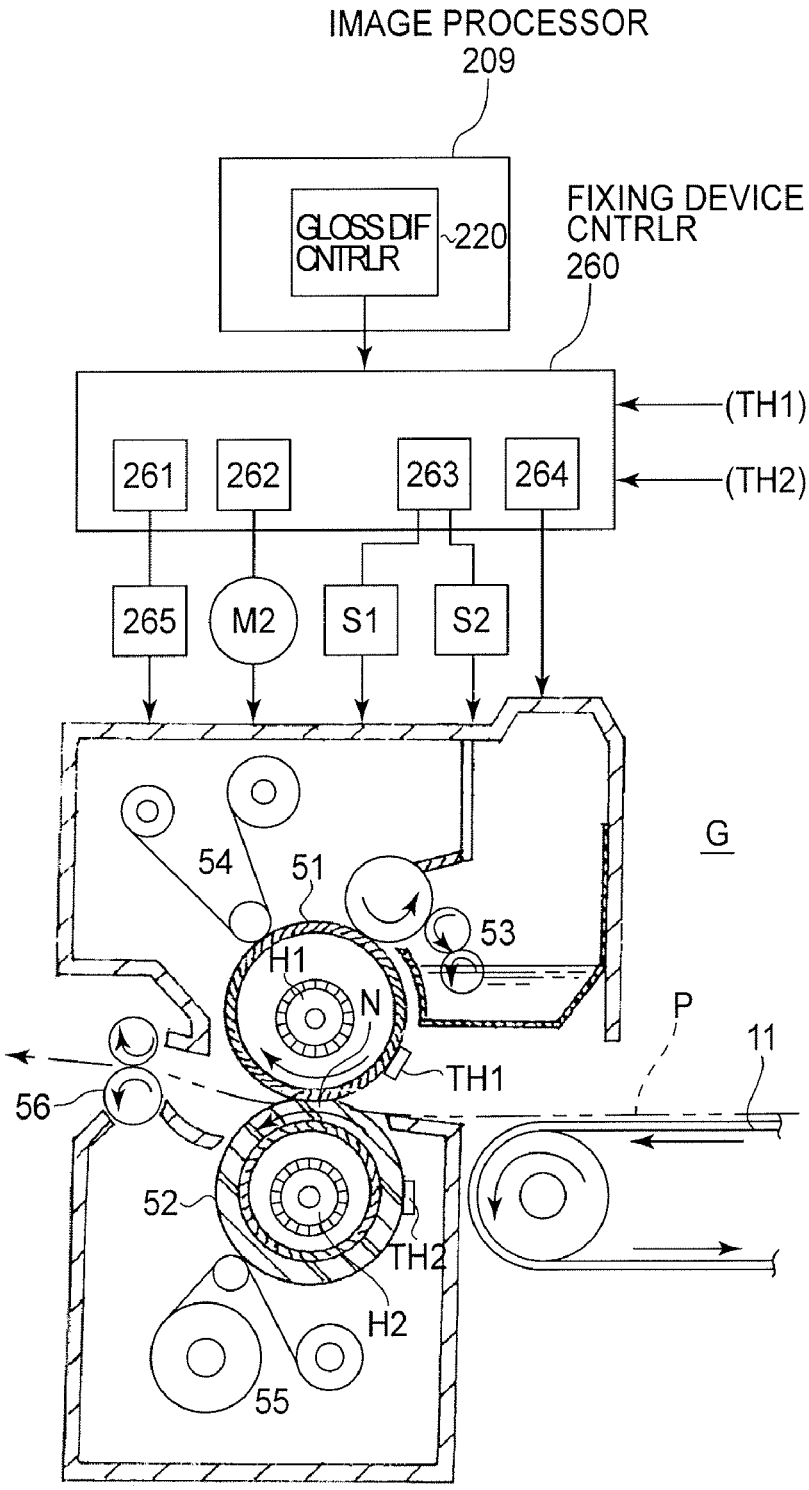
FIG. 3 is an enlarged view of a fixing device portion.

(2) Fixing Device G:

FIG. 3 is an enlarged schematic view of the image heating device in the form of the fixing device G. The fixing device G of this example is a heating roller type fixing device. Designated by 51 and 52 are a fixing roller and a pressing roller, respectively, which are rotatably supported by bearings and which are extended in parallel with each other, and one is above the other. The rollers 51, 52 are press-contacted to each other by a pressing mechanism 265 to form a fixing nip N.

The fixing roller 51 comprises a hollow metal roller of iron or aluminum and a parting layer of fluorinated resin material or the like on the outer surface thereof. The pressing roller 52 is an elastic roller and comprises a hollow core metal, an elastic layer of heat resistive rubber or the like and a parting layer. The fixing roller 51 and the pressing roller 52 are press-contacted to each other against the elasticity of the pressing roller elastic layer to form the fixing nip N of a predetermined width extending in the recording material feeding direction.

Designated by 260 is a fixing controller (change device) which controls the fixing execution condition (image heating condition) such as the fixing nip pressure of the fixing device G, the fixing temperature (image heating temperature), the recording material feeding speed (image heating speed) or the like. The fixing controller 260 is controlled by a glossiness difference controller 220 of an image processor 209 which will be described hereinafter.

The fixing controller 260 includes a pressing controller 261, a speed controller 262, an electric power supply control portion 263, a parting material application amount controller 264 or the like.

The pressing mechanism 265 is provided with a pressure cam for adjusting the pressure between the fixing roller 51 and the pressing roller 52 by controlling the angle of rotation thereof, for example. The pressing controller 261 is effective to control the angle of rotation of the pressure cam to maintain the pressure between the fixing roller 51 and the pressing roller 52 at a predetermined control pressing level.

The fixing roller 51 and the pressing roller 52 are rotated by a driving motor M2 in the directions indicated by the arrows while being in pressure contact to each other. The speed controller 262 controls the driving motor M2 to control, at a predetermined control level, the feeding speed of the recording material P, namely, the rotational speeds of the fixing roller 51 and the pressing roller 52 for pressing and heating both sides of the recording material P.

Inside the fixing roller 51 and the pressing roller 52, there are provided heaters H1, H2 such as halogen lamps, respectively. The heaters H1, H2 are supplied with electric power from voltage source circuits S1, S2, respectively to generate heat. By the heat generation of the heaters H1, H2, the fixing roller 51 and the pressing roller 52 are heated from the inside, respectively. The surface temperatures of the fixing roller 51 and the pressing roller 52 are monitored by the temperature sensors TH1, TH2 such as a thermister contacted thereto, and electrical information relating to the detected temperature is inputted to the fixing controller 260. The fixing controller 260 controls, on the basis of the input information, the electric power supply to the heaters H1, H2 from the voltage source circuits S1, S2 by controlling the electric power supply control portion 263 so as to maintain the surface temperatures (fixing temperature) of the fixing roller 51 and the pressing roller 52 at predetermined control temperature levels.

Designated by 53 is a parting material applicator for applying parting material (silicon oil) onto the surface of the fixing roller 51. Designated by 54 is a cleaning device of a web type for sweeping the surface of the fixing roller 51 to clean it. Designated by 55 is a cleaning device of a web type for sweeping the surface of the pressing roller 52 to clean it.

The fixing roller 51 and the pressing roller 52 are rotated, and the rollers 51, 52 are heated from the inside by the heaters H1, H2 so that surface temperatures are raised to the predetermined control temperatures and are maintained at the predetermined levels, respectively. In this state, the recording material P carrying the unfixed toner image is introduced to the fixing device G by the feeding belt 11 from the transfer belt mechanism F. The recording material P is nipped and advanced by the fixing nip N, during which it is heated by the fixing roller 51 and the pressing roller 52 and is pressed by the nip. By this, the multiplex toner image of the yellow, magenta, cyan and, black toner particles is fused and mixed and is fixed on the surface of the recording material P into a permanent fixed full-color image. The recording material P having been discharged from the fixing nip N is separated from the fixing roller 51 and pressing roller 52 by an unshown separation claw, and is delivered from the fixing device G by the sheet discharging roller 56.

The parting material applicator 53 applies silicon oil to the surface of the fixing roller 51 to prevent the toner from depositing on the surface of the fixing roller 51 when the recording material P passes between the fixing roller 51 and the pressing roller 52. The cleaning devices 54, 55 functions to remove the toner offset to the surface of the pressing roller 52.

The parting material application amount controller 264 functions to control the parting material applicator 53 to adjust the amount of silicon oil applied on the surface of the fixing roller 51.

(3) Selection (Setting) and Output of Image Having Glossiness Difference:

Here, the glossiness difference is a difference in glossiness between the achromatic color image portion (monochromatic image portion) and the chromatic color image portion (multi-color image portion) in the whole color output image of the recording material. The achromatic color image portion is a monochromatic image portion of the black toner. The chromatic color image portion is an image portion having a part formed by the chromatic toner, and it is a Y toner monochromatic image portion, a multi-color image portion where the Y toner, the M toner, the C toner, K toner are superimposed, for example. Even in the case that achromatic toner is color mixed into the chromatic color image portion, the reduction of the glossiness by the achromatic toner can be virtually ignored, and the glossiness of the entirety of the chromatic color image portion is substantially the same as in the case free of the achromatic toner. Therefore, the glossiness difference can be provided equivalently between chromatic color image portions and the achromatic color image portion which will be described hereinafter, irrespective of the existence of the achromatic color in the chromatic color image portion.

In this embodiment, for the purpose of outputting a color image having a glossiness difference desired by the user, the glossiness properties of the color toner (chromatic toner) (Y, M, C) and the achromatic toner (black toner (Bk)) are different from each other when the fixing conditions are the same.

In this embodiment, an plurality of glossiness difference selection modes are selectable. More particularly, in this embodiment, the following four glossiness difference selection modes are usable. The number of the usable modes is not limiting to the present invention, and may be larger or smaller. The words or naming of each of the modes may be another as long as it is proper. The glossiness difference selection modes are selectable irrespective of the kinds of recording materials.

Glossiness difference selection mode:

Mode (1): Color-clear and Monochromatic-matt mode:

Mode (2): Color-half-clear and Monochromatic-matt mode:

Mode (3): Color-matt & Monochromatic-matt mode: and

Mode (4): Color-normal & Monochromatic-normal mode.

In the mode (4) (color-normal and monochromatic-normal mode), the glossiness difference between the color portion and the monochromatic portion is inbetween those of mode (2) and mode (3) In mode (3), the glossinesses of the color portion and the monochromatic portion are substantially the same (the difference in the glossiness is not recognizable by human eyes although there is a difference actually).

In this embodiment, the glossiness difference control method in each of the modes is such that fixing controller controls the fixing temperature (target temperature of the fixing roller) of the fixing conditions of the fixing device G. The normal fixing temperatures are preset for the kinds of recording materials (thin paper, plain paper, thick paper or resin material coated paper or the like). More particularly, in an operating portion which will be described hereinafter, the kind of the recording material is set, and then the fixing controller reads information from the ROM storing data of fixing temperatures predetermined for respective kinds of recording materials, and the controlling operation is carried out.

Mode (1): the fixing temperature is 20° higher than the normal fixing temperature (large glossiness difference).

Mode (2): the fixing temperature is 10° higher than the normal fixing temperature (intermediate glossiness difference):

Mode (3): the fixing temperature is 10° lower than the normal fixing temperature (small glossiness difference).

Mode (4): the fixing temperature is normal fixing temperature.

The normal fixing temperature may be properly set depending on the structure of the apparatus and/or the toner property. For example, for the plain paper, it is approx. 180° in consideration of the fixing property, in this embodiment.

As described hereinbefore, in this example, the used toners are such that glossiness properties of the color toner (chromatic toner, Y, M, C) and the achromatic toner (black toner (Bk)) are different when the fixing conditions are the same.

Figure 4:
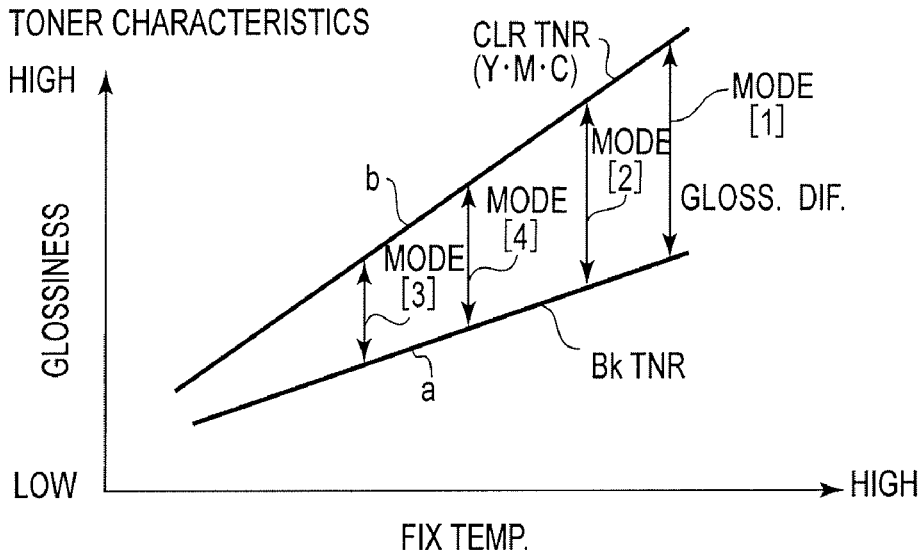
FIG. 4 illustrates a relation between a fixing temperature and a glossiness.

FIG. 4 shows a relation between the fixing temperature and the glossiness (glossiness of the fixed image) of the black toner and the color toner which are used in this embodiment. The relation between the glossiness and the fixing temperature is different if the toner amount (amount of the toner carried on the recording material) or the coloring material property (toner property) or the combination thereof is different.

In FIG. 4, designated by a is a graph of the relation between fixing temperatures of the black toner and the glossiness; b is a graph of the relation between the fixing temperature of the color toner and the glossiness. With increase of the fixing temperature, the glossiness of the fixed image increases, in either of the black toner or the color toner, but the up gradient of the glossiness relative to the fixing temperature is larger in the case of color toner than in the case of black toner.

Therefore, by switching or controlling the fixing temperature when the full-color image is to be outputted, the glossiness difference between the achromatic color image portion formed only by the black toner and the chromatic color image portion formed at least by the color toner can be changed.

Figure 5:
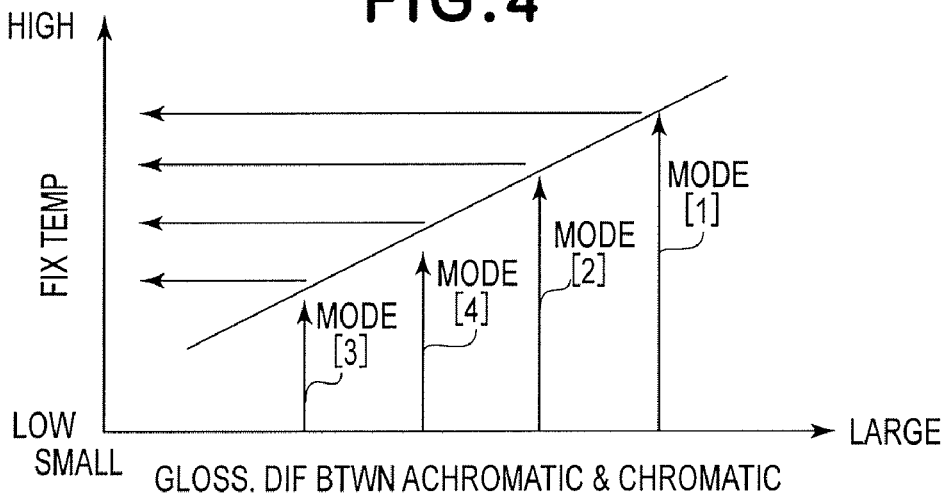
FIG. 5 shows an example of a glossiness difference property when a glossiness difference control is effected between an achromatic area and a chromatic area.

FIG. 5 shows an example of the glossiness difference property when the fixing temperature is switched to control the glossiness difference between achromatic color image portions and the chromatic color image portion. In FIGS. 4 and 5, the recording material P is plain paper having a basis weight of 80 g/m$^2$.

In this embodiment, glossiness difference selection modes (1) -(4) are prepared to provide different glossiness differences so that users can produce the images having a desired glossiness difference property.

Figure 13:
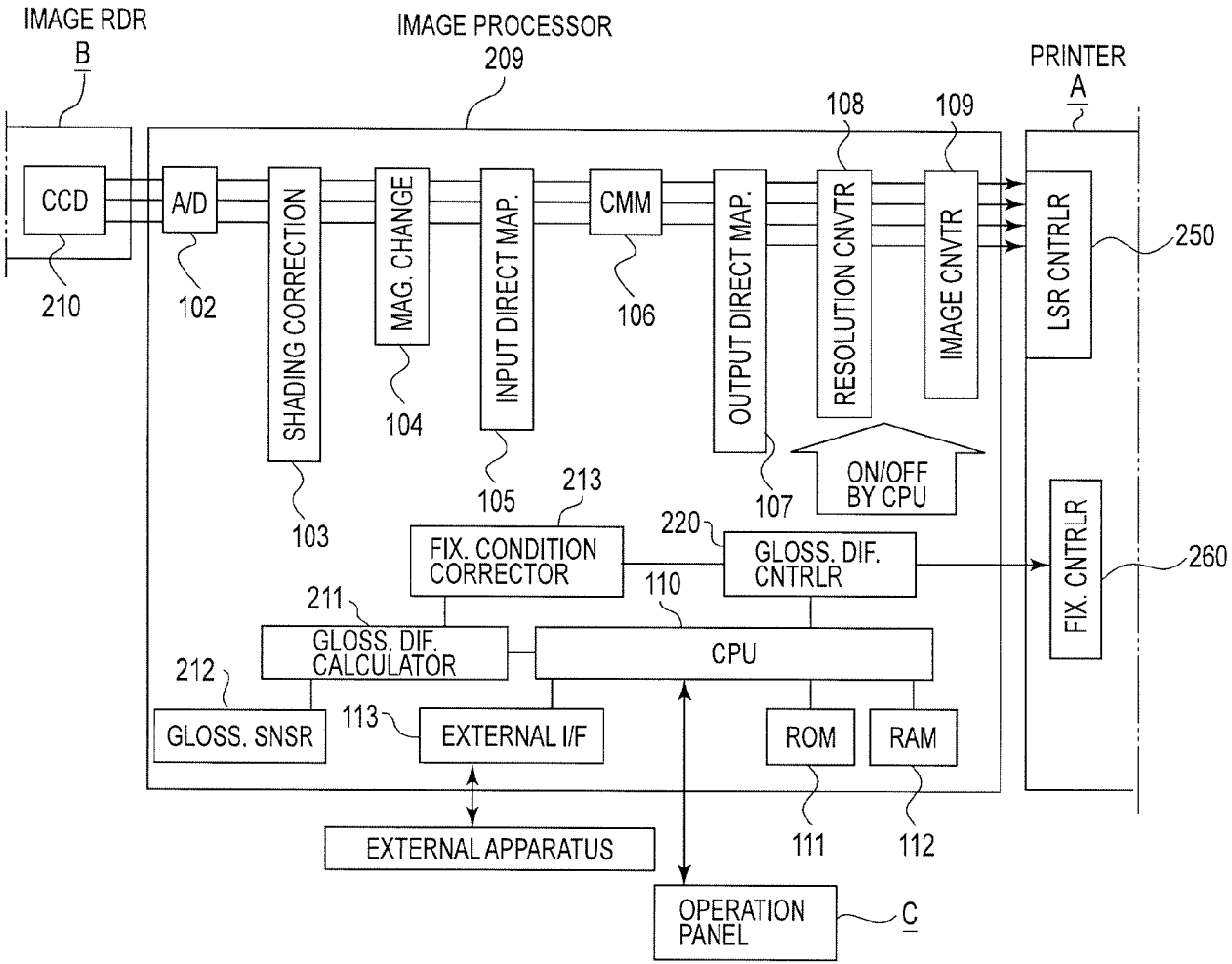
FIG. 13 is a block diagram of an image processor according to Embodiment 5 of the present invention.

More particularly, as shown in FIG. 13, the user can select or set one of the above-described glossiness difference selection modes on the operating portion (setting device) C including a liquid crystal displaying device on the top of the image forming apparatus. In other words, the user can set (input) on the operating portion the information corresponding to the glossiness difference between the achromatic color image portion and the chromatic color image portion. There are provided keys for setting the kinds of the recording material, keys for setting the monochromatic/color image formation mode, and so on. Thus, in this example, when the color image formation mode is selected, the glossiness difference selection is enabled. In addition, an automatic discrimination mode (for discrimination between monochromatic/color printing mode) is prepared, and when this mode is selected, the glossiness difference selection is enabled. More particularly, in the monochromatic image formation mode, the glossiness difference selection is disabled.

Figures 14, 15:
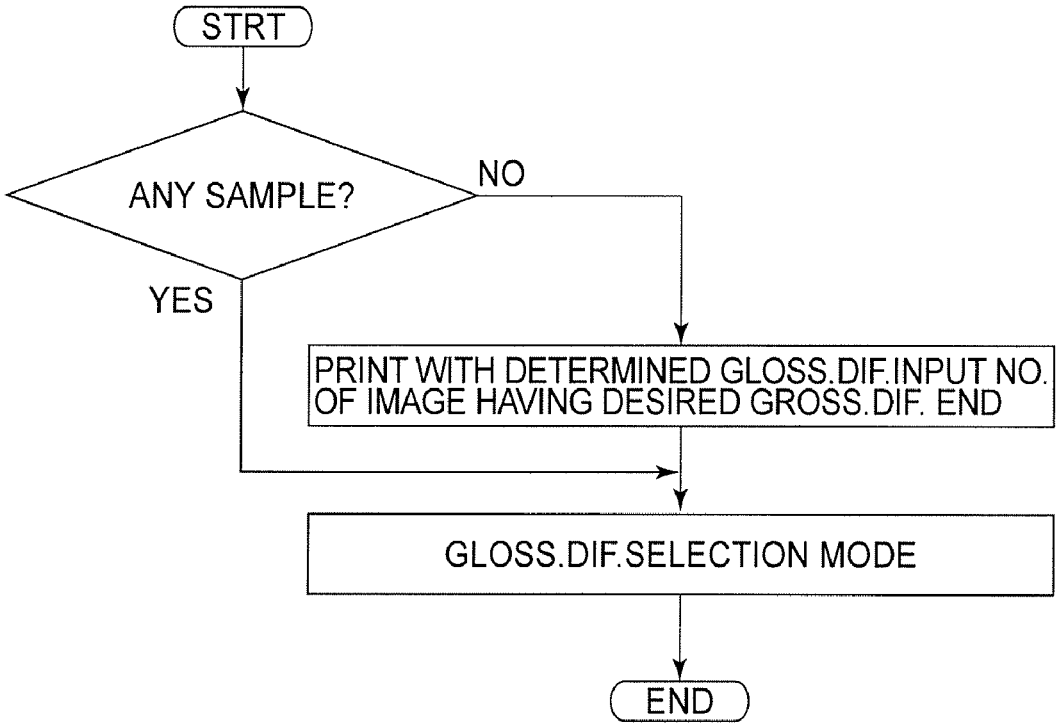
FIG. 14 is a flow chart from selection of an image having a glossiness difference to the output thereof according to Embodiment 6 of the present invention.
FIG. 15 illustrates a setting part in a print control screen wherein the output condition is set in a client PC.

In the case of an image forming apparatus (printer) not having an operation display and the setting is effected from an external device the host computer or the like), the setting screen as shown in FIG. 15 is preferable wherein a print control screen on the computer includes the portion shown in FIG. 15. Thus, the setting (input) of the information corresponding to the desired glossiness difference can be carried out by an external device (host computer or the like) connected with the image forming apparatus through a LAN cable (network connection). By such an arrangement, the display is made on the screen of an external device (host computer), and this is convenient when the image forming apparatus is used as the printer therefor. When the user checks the glossiness difference selection mode on the screen, one of the four modes is selectable. When the signal selecting the glossiness difference is inputted from the external device into the CPU (control means) 110 (changing means) through an interface 113, the CPU110 having received the signal sets the fixing condition in accordance with the setting of the glossiness difference.

Figure 6:
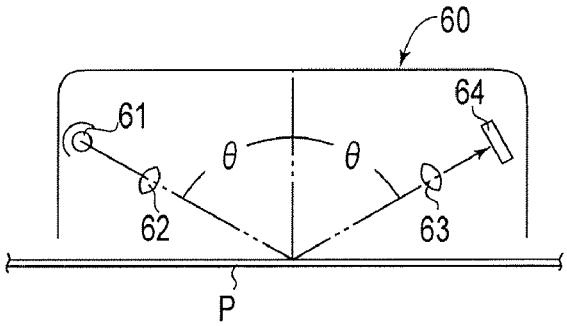
FIG. 6 illustrates schematic structure of a glossiness meter.

The glossinesses of the chromatic color image portion and the achromatic color image portion and the glossiness difference therebetween shown in FIGS. 4 and 5 are based on the image glossinesses determined in accordance with JIS Z8741 (Japanese Industrial Standards). More particularly, a light beam is incident on the recording material at a specified angle with a specified opening angle, and the reflected light beam in the direction of the mirror surface reflection is measured by a photoreceptor within a specified opening angle. FIG. 6 is a schematic view of such a glossiness detecting mechanism 60. The beam thrown from the light source 61 is incident through the lens 62 onto the recording material P at an angle fÆ. The beam reflected in the direction of mirror surface reflection is detected by the photoreceptor 64 through the lens 63. By using such a glossiness detecting mechanism 60, the surface glossiness of the recording material per se can be detected. In this example, the glossiness is detected with the incident angle fÆ of 60°.

Figure 7:
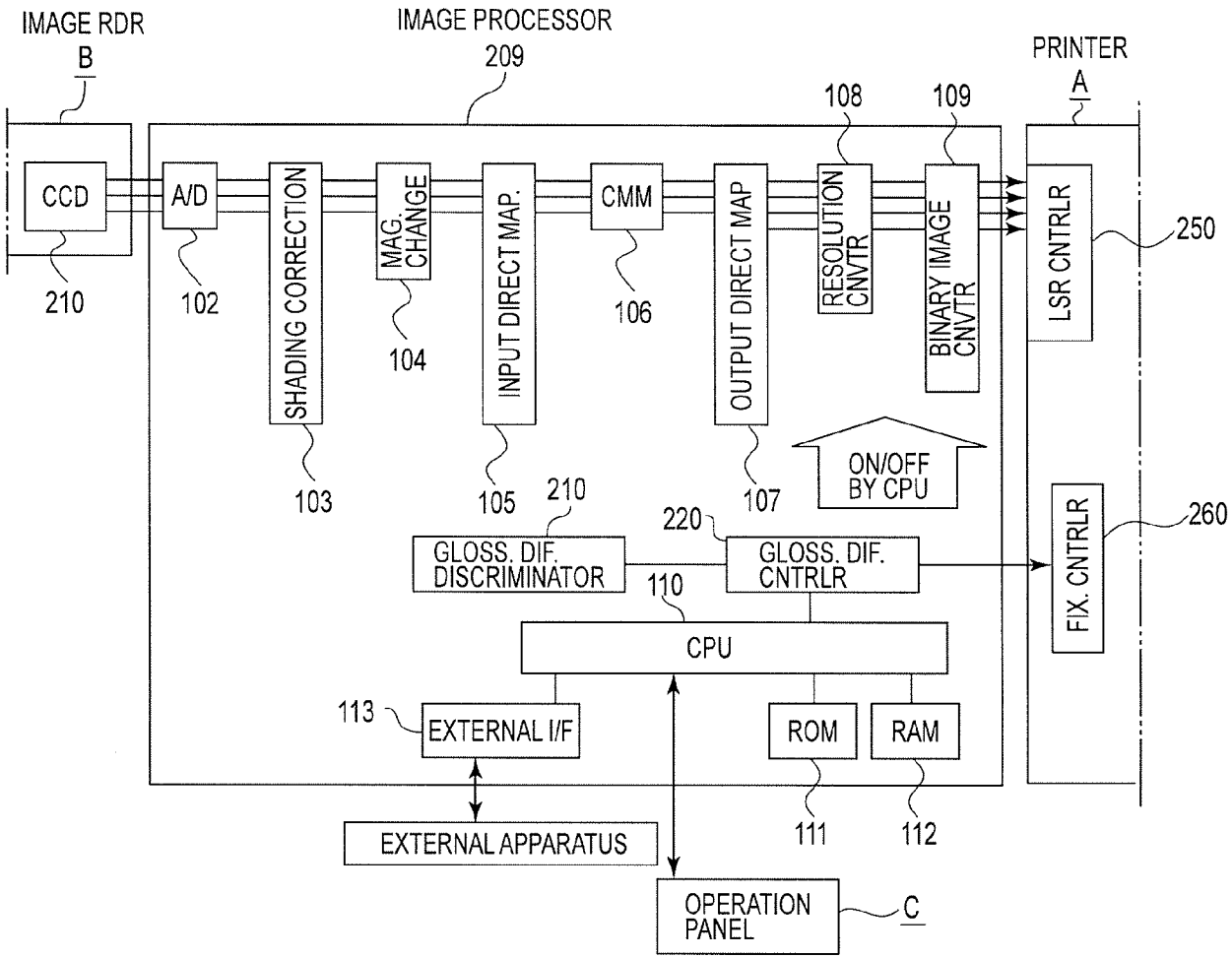
FIG. 7 is a block diagram of an image processor.

FIG. 7 is a detailed block diagram of the image processor 209 in this embodiment. The charge coupled device CCD210 in the original reading station B carries out a color separation photoelectric reading of the original image with the resolution of 600 dpi. The RGB signals provided by the read operation are inputted to the image processor 209.

In the image processor 209, designated by 102 is an AD converter for converting the signals inputted from the CCD210 into digital signals. Designated by 103 is a shading correction portion for correcting sensitivity non-uniformity of the pixels of the CCD210 and the light quantity non-uniformity on the light receiving surface resulting due to the non-uniformity of the illumination light quantity and/or lens optical system in the original reading station B. Designated by 104 is a variable magnification portion for controlling an image magnification. Designated by 105 is an input direct mapping portion for converting the read RGB signals into color space CIE L*a*b* independent from the device. Designated by 106 is a CMM (color management module) for effecting guide mapping to convert the reproduction capable of color space of the input device to color reproduction capable of color space in the output device. Designated by 107 is an output direct mapping portion for converting the CIE L*a*b* color space independent from the device to CMYK signals inherent to the output device. Designated by 108 is a resolution converting portion for converting the read resolution 600 dpi to 1200 dpi. Designated by 109 is a binary image processing converting portion for converting the multi-value signals to the binary image processing signals through a processing method such as an average density storing method. The converting portion 108 and the converting portion 109 can be on/off-controlled by control from the CPU110. The C, M, Y, K signals outputted from the binary image processing converting portion 109 are sequentially fed to the laser controller 250 of the laser scanning mechanism E in the printer station.

The CPU110 effects an overall control of the various elements in the image processor 209 on the basis of the control program stored in the ROM 111. The CPU110 is connected with an operation panel screen C and/or an external I/F113. Designated by 112 is a RAM which is an operation region of the CPU 110.

The description will be made as to the operation in the image processor 209, the operation of the glossiness mode storing portion, the fixing controller which relate to the outputting of the image having a desired glossiness difference.

Figure 8:
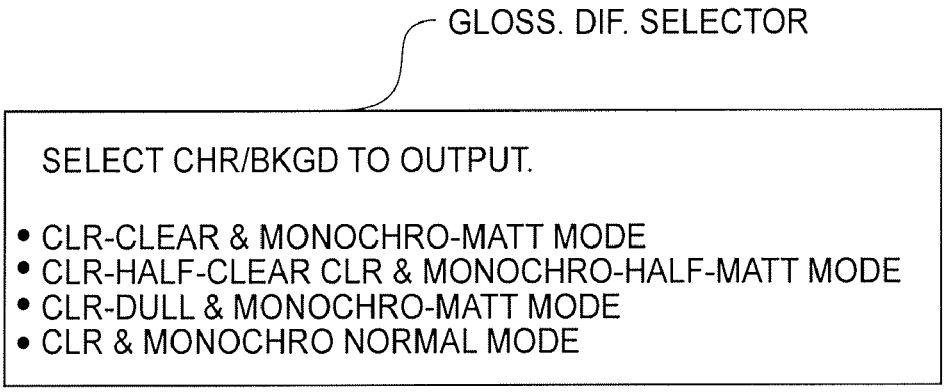
FIG. 8 illustrates a glossiness difference selection screen.

The user selects a desired glossiness difference selection mode from the four glossiness difference selection modes (1)-(4) on the glossiness difference selection screen (glossiness difference selecting means: touch panel, for example) as shown in FIG. 8 in the operation panel screen C in the setting device. The selected mode information is inputted to the image processor 209. The image processor 209 stores the inputted mode information in the storing portion (RAM) 110. The image processor 209 is provided with a desired glossiness difference discriminator 210 for discriminating the glossiness difference property selected by the user. The image processor 209 is provided with a glossiness difference controller 220 functioning as changing means for making a request to the fixing controller 260 of the fixing device G on the basis of the result of discrimination by the discriminator 210. In this manner, the image formation with the desired glossiness difference can be accomplished.

The ROM 111 of the image processor 209 stores relation property data indicative of the relation between the fixing temperature and fixed image glossiness or the glossiness difference as shown in FIG. 4 and/or FIG. 5 with respect to the used achromatic toner (black toner) and chromatic toner. When the glossiness difference information is inputted, the image processor 209 refers to the stored property data, and changes the fixing condition of the fixing device G which is the fixing temperature in this embodiment to the temperature condition corresponding to the inputted desired glossiness difference information. The printer station A carries out the color image forming operation under such a condition to outputs the color image having the desired glossiness difference between the achromatic color image portion and the chromatic color image portion.

Figure 9:
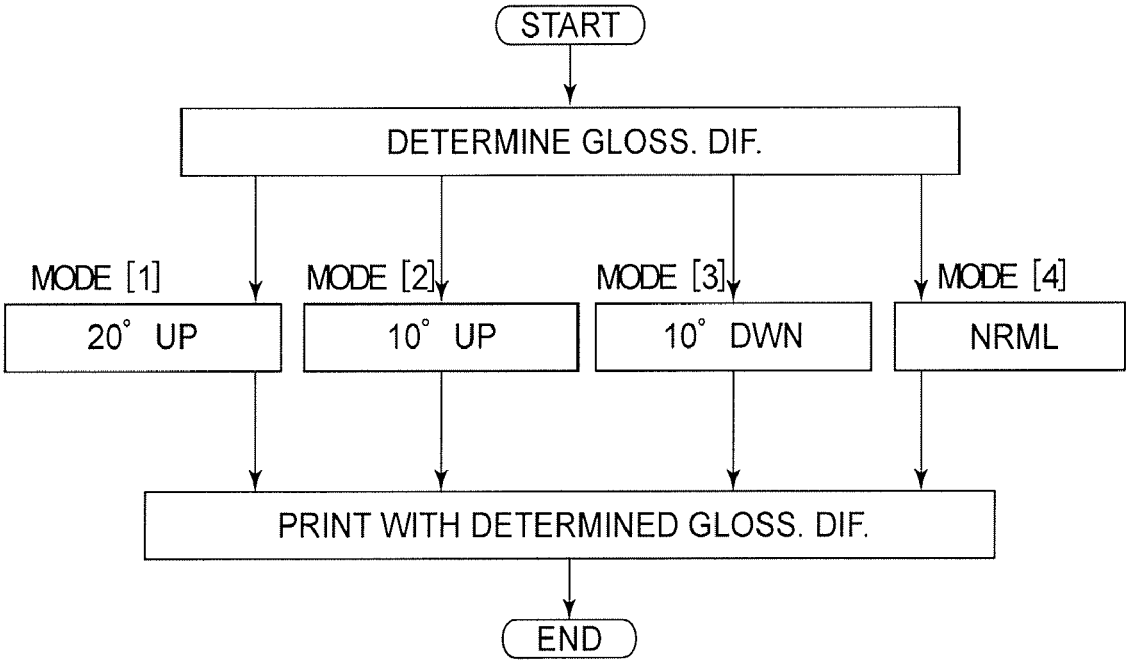
FIG. 9 is a flow chart from selection of an image having a glossiness difference to the output thereof.

In the image processor 209 in this embodiment, as shown in the flow chart of FIG. 9, the glossiness difference is determined on the basis of the information of the selected glossiness difference mode, and the image forming condition is determined accordingly. In this embodiment, the fixing temperature is determined. More specifically, in the case of mode (1), the fixing temperature is set to the level 20° higher than the normal fixing temperature. In the case of mode (2), the fixing temperature is set to the level 10° higher than the normal fixing temperature. In the case of mode (3), the fixing temperature is set to the level 10° lower than the normal fixing temperature. In the case of mode (4), the fixing temperature is the normal fixing temperature.

The fixing device G is set to the determined fixing temperature, and the image formation of the printer station A is carried out in the determined glossiness difference mode.

(4) Toner:

Each of the achromatic and chromatic coloring material property (toner property) is dependent on the binder resin, properties of two or more kinds of externally added material, fusion properties thereof, viscosity properties and molecular weights. The toner properties of the chromatic toner (yellow, magenta, cyan color toner) and the toner property of the achromatic toner (black toner) are prepared such that glossiness properties are different therebetween under the same fixing condition.

The toner used in this embodiment is produced by suspension polymerization, and the melting point of the black toner is 90°, and the melting point of the color toner is 100°.

The following is the composition of the yellow toner: (with the following composition, by replacing the C. I. yellow with magenta pigment, cyan pigment or carbon black, the magenta toner, the cyan the black toner are produced)

Styrene: 170 parts-by-weight:

Butyl metaacrylate: 30 parts-by-weight:

Paraffin wax (mp. 62°): 40 parts-by-weight:

α-olefin-malate-copolymer resin material: 2 parts-by-weight:

(in olefin part, cargon No. is 8) (5 wt % on the basis of wax):

C. I. Pigment yellow 17: 10 parts-by-weight:

Styrene—methacrylic acidmethyl copolymer resin material: 3 parts-by-weight:

Di tert—metal butyl salicylate chemical compound: 3 parts-by-weight:

These materials are mixed and dispersed at 70° by Hilinemil (available from Tokushukika Kogyo KABUSHIKI KAISHA) into monomer mixture.

With the temperature kept at 70°, 12 parts-by-weight of initiator of dimethyl 2,2'-azobisisobutyrate is added and dissolved.

The monomer mixture is fed into dispersive medium prepared in a vessel of a Homomixer.

The Homomixer is rotated for 15 min. At 7000 rpm. under nitrogen ambience at 70° so that monomer composition is granulated. Thereafter, the material is stirred by a stirring paddle blade for 10 hours at 70° for reaction.

After the completion of polymerization reaction, the material is cooled, and alkali material is added thereto; and then it is added with silica, is subjected to filtering, washing by water and drying, by which polymerized toner particles of 8.5 μm are provided.

Thereafter, 0.7 parts-by-weight of hydrophobic silica having a specific surface area by BET method of 200 $m^2/g$ is externally added to 100 parts-by-weight of the thus produced toner.

Into 7 parts-by-weight of the toner, 93 parts-by-weight of Cu—Zn—Fe ferrite carrier coated with styrene-methacrylic acidmethyl copolymer resin material are mixed to provide a two component developer.

One, the toner desirably has good fusing property and color mixture property upon application of heat thereto, and there is sharp melting toner which meets this desirability. Such sharp melting toner is produced by preparing toner material containing binder resin such a polyester resin material or styrene-acrylic ester resin material, coloring material (dye, sublimation dye), electrification control material and so on and then by melting and kneading, pulverizing and classifying the toner material. If desired, the toner may be externally added with various material (hydrophobic colloidal silica, for example). Taking the fixing property and sharp melting property of the color toner into account, the binder resin using polyester resin material is particularly preferable. Examples of polyester resin material having the sharp melting property include a polymeric chemical compound having ester linkage in the main chain of molecule synthesized by diol chemical compound and dicarboxylic acid, particularly the following:

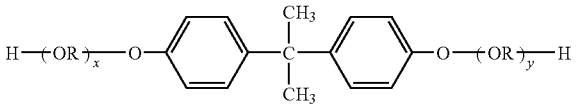

wherein R is ethylene or propylene; x and y are positive integers; and average of x+y is 2 to 10.

The diol component comprises a bisphenol derivative or a substitution product thereof exemplified by the following, and polyester resin material provided by at least condensation copolymerization thereof with carboxylic acid component.

Here, the carboxylic acid component comprises diatomic or higher carboxylic acid, anhydride thereof or lower alkyl ester thereof. More specifically, examples thereof include fumaric acid, maleic acid, maleic anhydride, phthalic acid, terephthalic acid, trimellitic acid, pyromellitic acid and so on.

Figure 16:
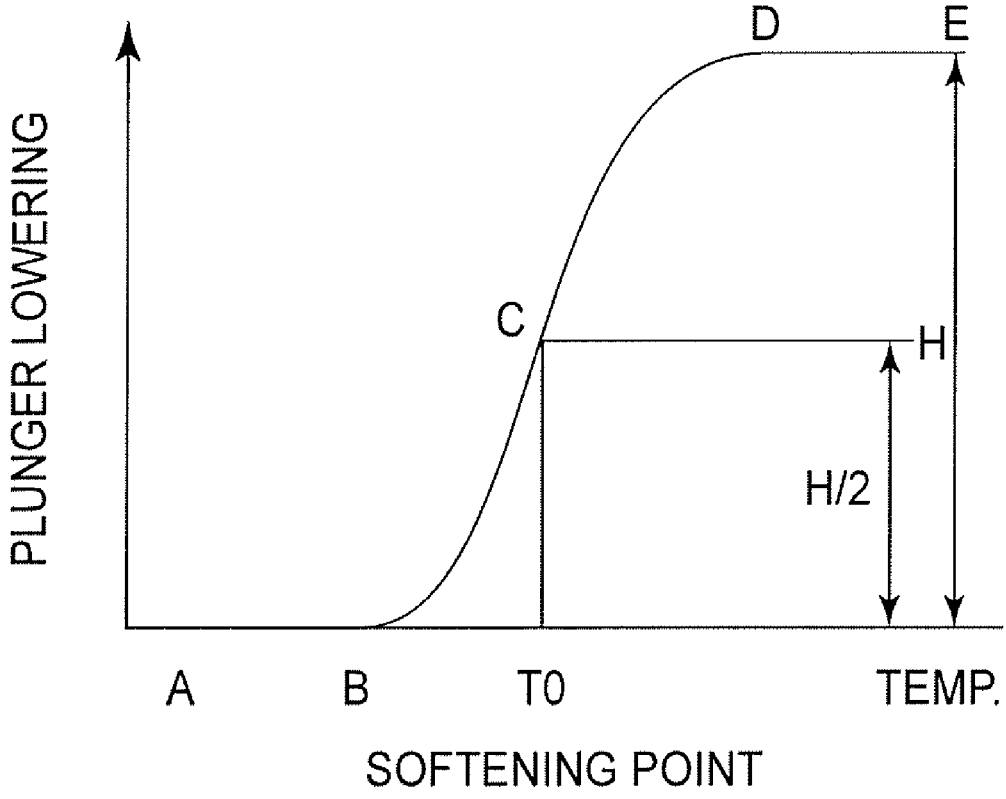
FIG. 16 shows an example of a softening property of sharp melting toner.

The softening point of the sharp melting polyester resin material is preferably 75-150° and further preferably 80-120°. FIG. 16 shows an example of the softening property of the sharp meltingtoner containing the polyester resin material as the binder resin. The measuring conditions are as follows: The measuring device is a flow tester CFT-500A (available from SHIMAZU SEISAKUSHO). The die (nozzle) has a diameter of 0.2 mm, and a thickness of 1.0 mm. The extrusion weight is 20 kg. The initial set temperature is 70°, and pre-heating time is 300 sec. The temperature is isokinetically raised at 6°/min, and a curve of plunger lowering vs temperature (softening S curve) is determined. The sample toner is 1-3 g of toner particles, and the cross-sectional area of the plunger is 1.0 $cm^2$. The softening S curve is as shown in FIG. 16. With the isokinetic temperature rise, the toner is gradually heated to flow out (A to B). With further temperature rise, the molten toner speedily flows out (B-C-D) so that plunger lowering stops (D-E).

The height H of the S curve corresponds to the total flowing amount, and temperature T0 corresponding to C point of H/2 corresponds to the softening point of the toner or the resin material. Whether or not the toner and the binder resin have the sharp melting property is discriminated by measuring the apparent fusing viscosity of the toner or binder resin.

The toner or binder resin having such a sharp melting property is defined by satisfaction of the following where T1 is a temperature exhibiting $10^3$ poise of apparent fusing viscosity, and T2 is a temperature exhibiting $5\times10^2$ poise:

$$T1=90°-150°:$$

$$|\Delta T|=|T1-T2|=5°-20°$$

The sharp melting property resin material having the temperature—fusing viscosity property is characterized by very sharp viscosity decrease by heat. Such a viscosity decrease causes proper mixture between the topmost toner layer and the bottommost toner layer, and steeply increases the transparent property of the toner layer per se thus causing satisfactory subtractive color mixture.

The toner (polymerized toner) using suspension polymerization is capable of internally containing wax so that good fixing property, anti-offset property and anti-blocking property are provided. Such toner, similarly to the pulverization type toner, exhibits a property that achromatic and the chromatic provide different glossiness properties under the same fixing condition. The mechanism thereof has not yet been completely known, but as to the achromatic material, the addition of the carbon black is significant. On the other hand, the chromatic toner does not use carbon as the coloring material.

The carbon black is used in many cases for the pulverization type achromatic toner, the polymerization type achromatic toner.

In this embodiment, the use is made with polymerization type toner, but the same effect can be provided in the pulverization type toner by adjustment of the fixing condition.

In addition, the fusing property is influential to the variation in the glossiness difference. In this embodiment, the fusing property is 90° in the achromatic toner and 100° in the chromatic toner.

Employing the structure of this example, an output print in which a monochromatic portion or color portion is conspicuous can be formed in the fields of graphic arts, POD, office use (presentation). In other words, the value of the color output prints can be enhanced.

Embodiment 2

According to this embodiment, when the glossiness difference image formation outputting mode is executed, sample images with different glossiness difference properties are outputted to permit the user to see the degree of actual glossiness difference, so that user can easily discriminate the desired glossiness difference setting.

Figure 11:
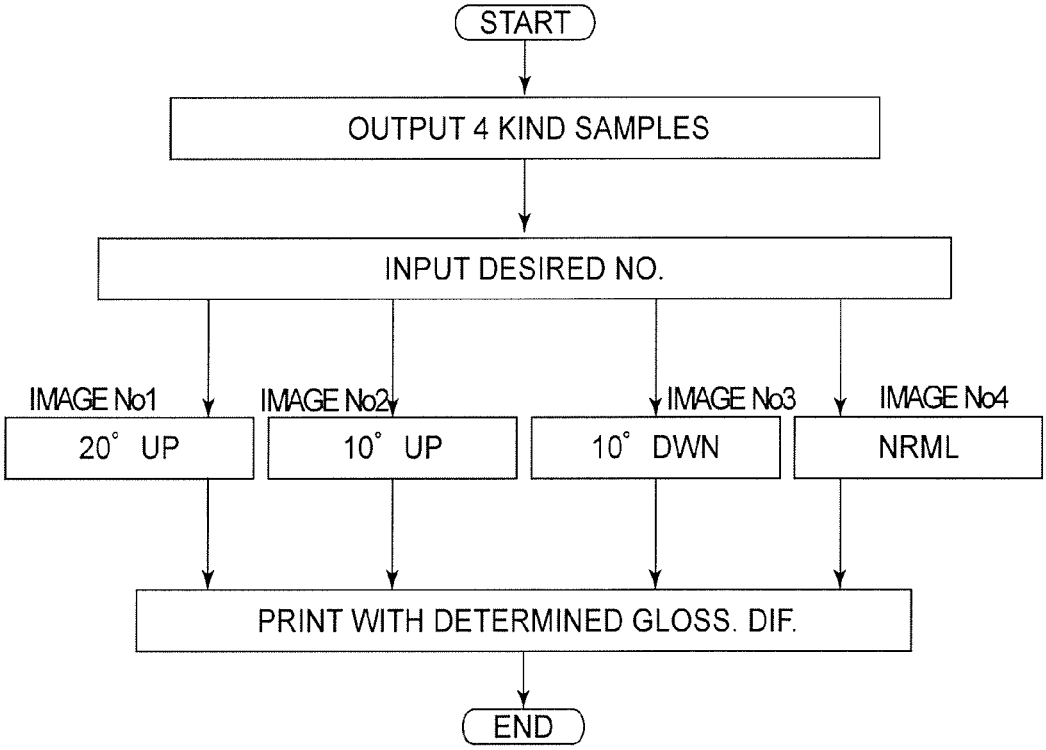
FIG. 11 is a flow chart from selection of an image having a glossiness difference to the output thereof according to Embodiment 2 of the present invention.

FIG. 11 is a flow chart showing selection and output of an image having a glossiness difference in this embodiment.

The user inputs the glossiness difference image formation outputting mode on an operation panel screen C. An image processor 209 executes the operation of the printer A in a sample image formation outputting mode in accordance with the input. More particularly, the image processor 209 executes the image forming operation of the printer A for forming color chart images under some predetermined fixing conditions pre-stored in the ROM 111. By this, a plurality of color sample images (reference images) having stepwisely different glossiness differences between the achromatic color image portions and chromatic color image portions are outputted. In the flow chart of FIG. 11, four sample images having different glossiness difference properties, respectively are outputted. The chart images producing the sample images are pre-stored in the ROM 111 of the image processor 209. The chart image preferably is a mixture of letters and figure images. The four sample image may be formed on one recording material as well as on the four recording materials, respectively.

The number output sample images having stepwisely different glossiness differences is preferably 3-8 in consideration of the temperature control function of the fixing device G, the waiting time required for the outputting, and the effects of the present invention. However, the number may be larger or smaller.

The user selects a desired glossiness difference one or the one close thereto among the outputted sample images. The outputted sample images are given numbering 1-4 for easy identification.

Figure 10:
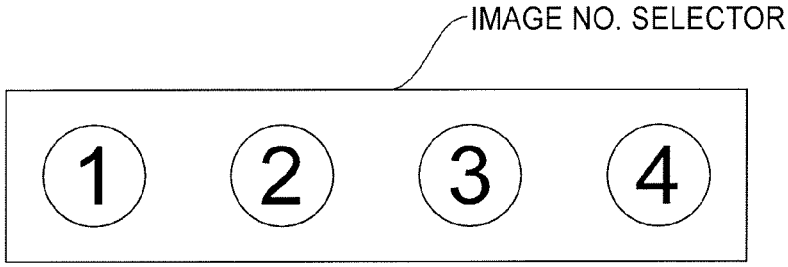
FIG. 10 shows an image number selection screen used in an apparatus according to Embodiment 2 of the present invention.

The user selects the image number of the chart image having the desired glossiness difference on the image number selection screen (touch panel, for example), as shown in FIG. 10, of the operation panel screen C. The selected image number is inputted in the image processor 209. The image processor 209 determines the image forming condition corresponding to the selected image number.

The ROM 111 of the image processor 209 stores relation property data indicative of the relation between the fixing temperature and fixed image glossiness or the glossiness difference as shown in FIG. 4 and/or FIG. 5 with respect to the used achromatic toner (black toner) and chromatic toner. When the glossiness difference information is inputted, the image processor 209 refers to the stored property data, and changes the fixing condition of the fixing device G which is the fixing temperature in this embodiment to the temperature condition corresponding to the inputted sample image number information. The printer station A carries out the color image forming operation under such a condition to outputs the color image having the desired glossiness difference between the achromatic color image portion and the chromatic color image portion.

In this embodiment, the fixing temperature is determined as shown in FIG. 11. More specifically, The case of image number 1 corresponds to the mode 1 in Embodiment 1, and the fixing temperature is 20° higher than the normal fixing temperature.

The case of image number 2 corresponds to the mode 2 in Embodiment 1, and the fixing temperature is 10° higher than the normal fixing temperature.

The case of image number 3 corresponds to the mode 3 in Embodiment 1, and the fixing temperature is 10° lower than the normal fixing temperature.

The case of image number 4 corresponds to the mode 4 in Embodiment 1, and the fixing temperature is the normal fixing temperature.

The fixing device G is set to the determined fixing temperature, and the image formation of the printer station A is carried out in the determined glossiness difference mode.

In Embodiment 1 and Embodiment 2, memory medium or recorded material having the program code of software for executing the function is supplied to the system or apparatus. Alternatively, a computer (CPU or MPU) of the system or apparatus reads the program code stored in the memory medium and executes the function.

In this case, the program code per se executes the function of the embodiment, and the memory medium storing the program code constitutes the present invention.

By executing the program code read by the computer, the functions of Embodiment 1 and Embodiment 2 are realized. In addition, on the basis of the commands from the program codes, the operating system (OS) working in the computer or the like executes a part or all of the actual processes, the above-described functions may be realized by the processes.

The program codes read out of the memory medium are written in the memory of the function extending unit connected to the computer or a function expanding card inserted in the computer. Thereafter, on the basis of instructions from the program code, the CPU or the like provided in the function expanding card or the function extending unit may execute a part or all of the actual processes, by which the above-described functions are realized.

Embodiment 3

In this embodiment, the glossiness difference control is effected by changing the fixing speed of the fixing device G.

The glossiness difference control can be accomplished by the fixing speed as well as by the fixing temperature.

Figure 12:
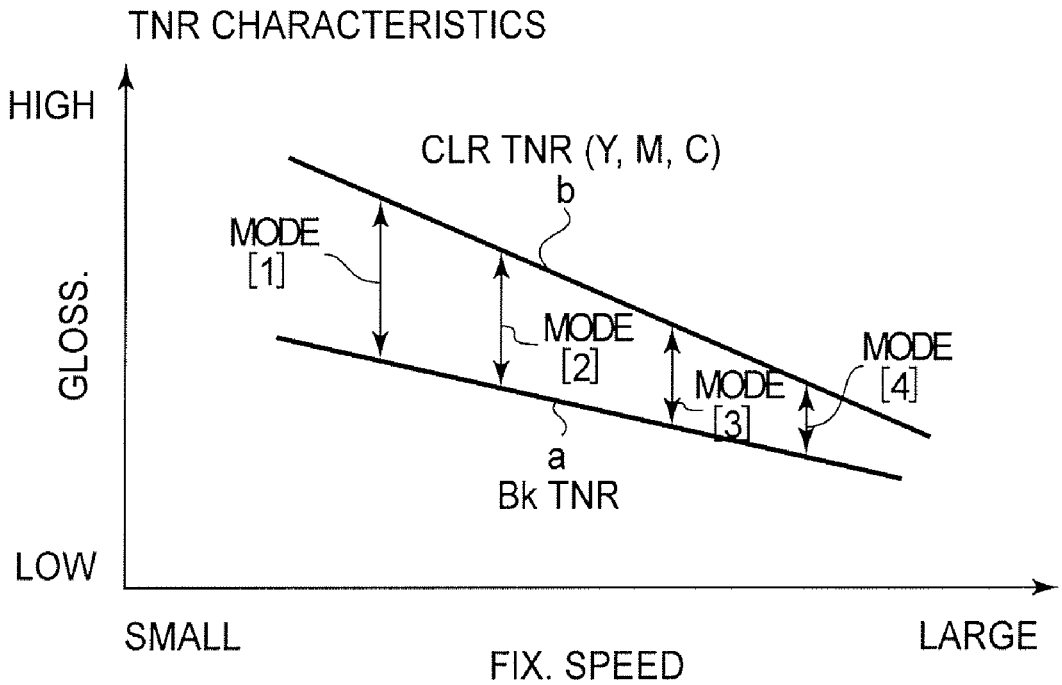
FIG. 12 shows a relation between a fixing speed and a glossiness difference.

FIG. 12 shows a relation between the fixing speeds of the achromatic toner (black toner) and the chromatic toner (color toner) and the glossiness (glossiness of fixed image).

In FIG. 12, is a graph wherein a is the fixing speed of the black toner vs the glossiness, b is the fixing speed of the color toner vs the glossiness. In the black toner and the color toner, the glossiness rises with increasing of the fixing speed, but the up gradient of the glossiness relative to the fixing speed is larger in the case of the color toner than in the case of the black toner. Therefore, in the color image outputting operation, the glossiness difference between the achromatic color image portion and the chromatic color image portion can be changed by controlling the fixing speed. FIG. 12 deals with the case of the recording material P being plain paper having a basis weight of 80 g/m$^2$.

In this embodiment, there are provided four modes (1)-(4) similarly to Embodiments 1 and 2.

In this embodiment, the fixing speed is controlled as the fixing condition of the fixing device G as follows:

Mode (1): the fixing speed is 20% lower than the normal fixing speed (large glossiness difference):

Mode (2): the fixing speed is 10% lower than the normal fixing speed (intermediate glossiness difference):

Mode (3): the fixing speed is 10% higher than the normal fixing speed (small glossiness difference): and Mode (4): the fixing speed is the normal fixing speed.

By the preparation of the four glossiness difference selection modes, the images having the glossiness difference property desired by the user can be outputted, similarly to Embodiments 1 and 2.

Embodiment 4

In this embodiment, the glossiness difference control is effected by a combination of the fixing temperature and the fixing speed.

It has been revealed that control by a combination of the fixing temperature and the fixing speed is effective to expand the variable range of the glossiness difference. The fixing condition parameters influential to the glossiness difference include the fixing temperature, the fixing speed, the fixing pressure, the oil application amount, the oil temperature or the like.

This Embodiment 3 is a combination of Embodiment 1 and Embodiment 3 or a combination of Embodiment 2 and Embodiment 3, and the control fixing condition in the glossiness difference mode is the fixing temperature and the fixing speed.

Embodiment 5

In this embodiment, a glossiness difference between the chromatic color image portion and the achromatic color image portion of the fixed image on the recording material discharged from the fixing device G of the image forming apparatus of any one of Embodiments 1-4 is detected, and the fixing condition is corrected in the direction of reducing the deviation between the detected glossiness difference and the glossiness difference corresponding to the selected glossiness difference selection mode.

FIG. 13 is a detailed block diagram of an image processor 209 according to this embodiment. In the description of this embodiment, the same reference numerals as in FIG. 7 are assigned to the elements having the corresponding functions in this embodiment, and the detailed description thereof is omitted for simplicity. In this embodiment, the result of detection by the glossiness sensor 212 (detecting means) is processed by a glossiness difference calculation portion 211. On the basis of the result of the processing, the fixing condition is corrected by a fixing condition correction portion 213 (correcting means) so as to provide a predetermined glossiness difference.

The calculation formula in the glossiness difference calculation portion 211 is:

Glossiness difference=(glossiness of chromatic color image portion)−(glossiness of achromatic color image portion)

In this embodiment, a glossiness sensor 212 for detecting the glossiness of the fixed image on the recording material discharged from the fixing device G is disposed at a position between the fixing device G and the selector 12 in the image forming apparatus of one of Embodiments 1-4. The glossiness sensor 212 has the same structures and functions as the glossiness meter of FIG. 6. An image controller 209 measures, at a predetermined control timing, the glossiness of the chromatic color image portion and the glossinesses of the achromatic color image portion of the fixed image on the recording material discharged from the fixing device G. The information of the measurement is inputted to the glossiness difference calculation portion 211. A glossiness difference calculation portion 211 calculates a glossiness difference between the chromatic color image portion and the achromatic color image portion of the color image outputted actually by the above formula. A fixing condition correction portion 213 calculates a deviation between the actual glossiness difference detected on the output color image and the glossiness difference corresponding to the selection glossiness difference selection mode, and corrects the fixing condition in the direction of reducing the deviation. A glossiness difference controller 220 controls the fixing controller 260 so as to carry out the fixing operation of the fixing device G under the corrected fixing condition provided by the fixing condition correction portion 213.

By this, the color image can be outputted with the glossiness difference substantially the same as the glossiness difference corresponding to the selected glossiness difference selection mode.

Embodiment 6

In this embodiment, the use is made with the image forming apparatus of Embodiment 2, but referring to the flow chart of FIG. 10, no sample image is outputted when the desired glossiness difference is selected. In place thereof, a system for executing a control flow chart capable of outputting an image with a desired glossiness difference is provided.

More particularly, to the flow chart of FIG. 10 the following is added:

"Do you have four samples having different glossiness differences property".

This appears on the operating portion or panel. Simultaneously, a selection box including "yes" and "no" is added.

FIG. 14 is a flow chart. When the user selects "yes", the image forming apparatus discriminates that there are samples, and the system prompts the user to input the image number having the desired glossiness difference on the operating portion.

When the user selects "no", the image forming apparatus discriminates that there is no sample, and automatically outputs four sample images having different glossiness difference properties. Thereafter, the apparatus prompts the user to input the image number having the desired glossiness difference. The outputting sequential operations thereafter are the same as in Embodiment 2.

In this manner, the image forming apparatus of this embodiment is improved over the image forming apparatus of Embodiment 2.

Embodiment 7

In Embodiment 1-6, the use is made with cyan toner (dark cyan toner), magenta toner (dark magenta) toner and yellow toner as the chromatic toner. In this embodiment, additional toner is used.

The additional toner includes light cyan toner and light magenta toner as the chromatic toner, and light black (gray toner) as the achromatic toner.

The dark cyan toner and light cyan toner have substantially the same hue but different densities. The same applies to the dark magenta toner and the light magenta toner.

Examples of the coloring material for the light color cyan toner and dark color cyan toner in this embodiment include copper phthalocyanine compound, derivative thereof, anthraquinone chemical compound, basic dye lake chemical compound or the like.

Particularly preferable coloring material is C. I. Pigment blue 1, 7, 15, 15: 1, 15: 2, 15: 3, 15: 4, 60, 62, 66

The coloring material for the light color cyan toner and dark color cyan toner may contain another coloring material such as the yellow coloring material and/or the magenta coloring material.

By mixing these coloring materials, a*, b*, c*, L* may be adjusted.

The coloring materials usable for the light magenta toner and dark magenta toner may be condensation azo-compound, diketopyrrolopyrrole compound, anthraquinone, quinacridone compound, for example. Furthermore, it may be basic dye lake compound, naphthol compound, benzimidazolone compound, thioindigo compound or perylene compound.

Particularly preferable coloring material is:

C. I. red 31, 48: 1, 48: 2, 48: 3, 48: 4, 57: 1, 88, 95, 144, 146, 150, 177, 202, 214, 220, 221, 254, 264, 269, C. I. Pigment violet 19.

The coloring material for the light color magenta toner and dark color magenta toner may contain another color coloring material such as yellow coloring material and/or cyan coloring material. By mixing these coloring materials, a*, b*, c*, L* can be adjusted.

These coloring materials can be used alone or in combination. Furthermore, solid solution is usable. The coloring material is selected from the standpoint of the hue-angle, the chromaticity, the lightness, the atmospheric corrosion resistance, OHP transparent property, dispersion property in the toner particle. The coloring material is preferably pigment.

The preferable amount of addition of the coloring material is different depending on the kind of used coloring material. But, the content of the light color cyan toner and light magenta toner is 0.4-1.5 weight % on the basis of the total amount of toner, the content of the dark color cyan toner and dark magenta toner is 2.5-8.5 weight % on the basis of the total amount of the toner.

The tendency of glossiness change of the light color toner depending on the fixing condition is quite the same as that of the dark color toner. This is because the influence of the amount and/or kind of the coloring material to the glossiness is normally small. Rather, what are dominant to the glossiness are the binder resin, the wax, the melting property and/or affinity and viscosity property, molecular weight of them. The other properties are not significantly different between the light color toner and the dark color toner.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 363188/2005 filed Dec. 16, 2005 which is hereby incorporated by reference.

What is claimed is:

1. An image forming apparatus comprising:

an image forming device configured to form a multi-color image using achromatic toner and chromatic toner;

an image heating device configured to heat the multi-color image formed on a recording material;

a setting device configured to permit setting of one of plural modes including (a) a first mode in which a glossiness difference between an achromatic image portion and a color image portion in the multi-color image is large, and (b) a second mode in which the glossiness difference between the achromatic image portion and the color image portion is smaller than the glossiness difference in the first mode; and a controlling device configured to control an image heating condition of said image heating device in accordance with the mode set by said setting device.

2. An apparatus according to claim 1, wherein the image heating condition includes at least one of an image heating temperature and an image heating speed.

3. An apparatus according to claim 1, wherein said apparatus is operable in a test mode wherein reference images are outputted under different image heating conditions.

4. An apparatus according to claim 3, wherein in said test mode, an image for discriminating the glossiness difference is outputted together with the reference images.

5. An apparatus according to claim 1, wherein said setting device includes a key for setting a kind of the recording material, and said controlling device controls the image heating condition in accordance with the set kind of recording material and the set mode for the glossiness difference.

6. An apparatus according to claim 1, wherein said setting device permits setting of the set mode for the glossiness difference independently of the kind of recording material.

7. An apparatus according to claim 1, further comprising a detecting device configured to detect a glossiness of a reference image formed under a predetermined image heating condition, and a correcting device configured to correct the predetermined image heating condition in accordance with a result of detection of the glossiness of the achromatic image portion and the glossiness of the color image portion in the reference image.

8. An apparatus according to claim 1, wherein the achromatic toner includes at least black toner, and the chromatic toner includes at least yellow toner, magenta toner and cyan toner.

9. An image forming method comprising:

an image forming step of forming a multi-color image using achromatic toner and chromatic toner;

an image heating step of heating the multi-color image formed on a recording material;

a setting step of setting one of plural modes including (a) a first mode in which a glossiness difference between an achromatic image portion and a chromatic image portion in the multi-color image is large, and (b) a second mode in which the glossiness difference between the achromatic image portion and the chromatic image portion is smaller than the glossiness difference in the first mode; and a controlling step of controlling an image heating condition in said image heating step in accordance with the mode set in the setting step.

10. A method according to claim 9, wherein the image heating condition includes at least one of an image heating temperature and an image heating speed.

11. A method according to claim 9, further comprising a reference image outputting step of outputting reference images under different image heating conditions.

12. A method according to claim 11, wherein in said reference image outputting step, an image for discriminating the glossiness difference is outputted together with the reference images.

13. A method according to claim 9, wherein said controlling step controls the image heating condition in accordance with the kind of recording material and the glossiness difference set in said setting step.

14. A method according to claim 9, wherein said forming step forms the multi-color image on the recording material using achromatic toner including at least black toner and chromatic toner including at least yellow toner, magenta toner, and cyan toner.

* * * * *